US006021840A

United States Patent [19]

Colvin

[11] Patent Number: 6,021,840

[45] Date of Patent: Feb. 8, 2000

[54] VACUUM DIE CASTING OF AMORPHOUS ALLOYS

[75] Inventor: Gregory N. Colvin, Muskegon, Mich.

[73] Assignee: Howmet Research Corporation, Whitehall, Mich.

[21] Appl. No.: 09/012,347

[22] Filed: Jan. 23, 1998

[51] Int. Cl.[7] ..... B22D 17/04

[52] U.S. Cl. ..... 164/113; 164/122; 164/312

[58] Field of Search ..... 164/113, 65, 312, 164/122

[56] References Cited

U.S. PATENT DOCUMENTS

| | | | |
|---|---|---|---|
| 4,856,576 | 8/1989 | Peterson | 164/495 |
| 5,030,519 | 7/1991 | Scruggs et al. | 164/495 |
| 5,567,532 | 10/1996 | Peker et al. | 428/457 |
| 5,711,363 | 1/1998 | Scruggs et al. | 164/113 |

*Primary Examiner*—Patrick Ryan
*Assistant Examiner*—Anjan Dey

[57] ABSTRACT

A method for die casting an amorphous metal or alloy using high vacuum die casting machine and die casting parameters effective to produce three dimensional net shape die cast components that retain at least 50 volume % or more amorphous phase in the die cast microstructure. The die cavity is evacuated to a vacuum level of less than 1000 microns through the shot sleeve, a superheated molten amorphous zirconium-copper-nickel-berylium alloy is introduced into the shot sleeve, the plunger is advanced at speeds in the range of 5 inches/second to 500 inches/second to force the molten metal or alloy into a sealed, evacuated die cavity where at least the outer surface or shell of the die cast component can solidify before opening of the dies to break the vacuum seal(s) and expose the cast component to ambient air atmosphere. The die component is removed from the opended dies and quenched in a quenchant medium, such as water, to produce a die cast microstructure including at least 50 volume % amorphous phase.

7 Claims, 2 Drawing Sheets

VACUUM DIE CASTING OF AMORPHOUS ALLOYS

FIELD OF THE INVENTION

The present invention relates to die casting of metals and alloys and, more particularly, to vacuum die casting of amorphous metals and alloys under vacuum die cavity conditions.

BACKGROUND OF THE INVENTION

U.S. Pat. No. 5,288,344 describes amorphous zirconium-copper-nickel-berylium alloys that retain at least a 50 volume % glassy or amorphous phase in the microstructure upon cooling from the alloy melting temperature, $T_m$, to below the alloy glassy temperature, $T_g$. The patent describes production of one (1) millimeter thick strips of the amorphous alloy with more than 50 volume % amorphous phase in the microstructure.

Low cost casting of reactive metals and alloys such as titanium and titanium and nickel based alloys using permanent, reusable, multi-part metal molds based on iron and titanium is described in Colvin U.S. Pat. No. 5,287,910. Casting of aluminum, copper, and iron based castings using permanent metal molds is described in U.S. Pat. No. 5,119,865.

Copending application Ser. No. 08/928,842 entitled "High Vacuum Die Casting" of common inventorship and assignee herewith describes a die casting machine for casting reactive metals and alloys which are melted and introduced into the shot sleeve under relatively high vacuum levels and then cast into a die cavity defined between sealed dies disposed in ambient atmosphere.

SUMMARY OF THE INVENTION

The present invention provides in one embodiment a method for die casting an amorphous metal or alloy using the aforementioned high vacuum die casting machine and selected die casting parameters effective to produce three dimensional net shape die cast components that retain at least 50 volume % or more amorphous phase in the die cast microstructure.

An illustrative embodiment of the invention involves evacuating the die cavity to a vacuum level of less than 1000 microns, such as for example about 25 microns or less, through the shot sleeve or otherwise, introducing a superheated molten amorphous alloy, such as zirconium-copper-nickel-berylium alloy, into the shot sleeve, advancing the plunger at speeds in the range of 5 inches/second to 500 inches/second to force the molten metal or alloy into a sealed, evacuated die cavity where at least the outer surface or shell of the die cast component can solidify before opening of the dies to break the vacuum seal(s) and expose the cast component to ambient air atmosphere, removing the die cast component from the opened dies, and quenching the die cast component in a quenchant medium, such as water.

Details of the present invention will become more readily apparent from the following detailed description taken with the following drawings.

DETAILED DESCRIPTION OF THE INVENTION

The present invention is especially useful in die casting amorphous alloys, such as including but not limited to zirconium-copper-nickel-berylium alloys described below, to produce three dimensional net shape components of myriad configurations, such as, for example only, golf club heads, golf putters, airfoils such as gas turbine engine blades and vanes, and others.

Figure 1:
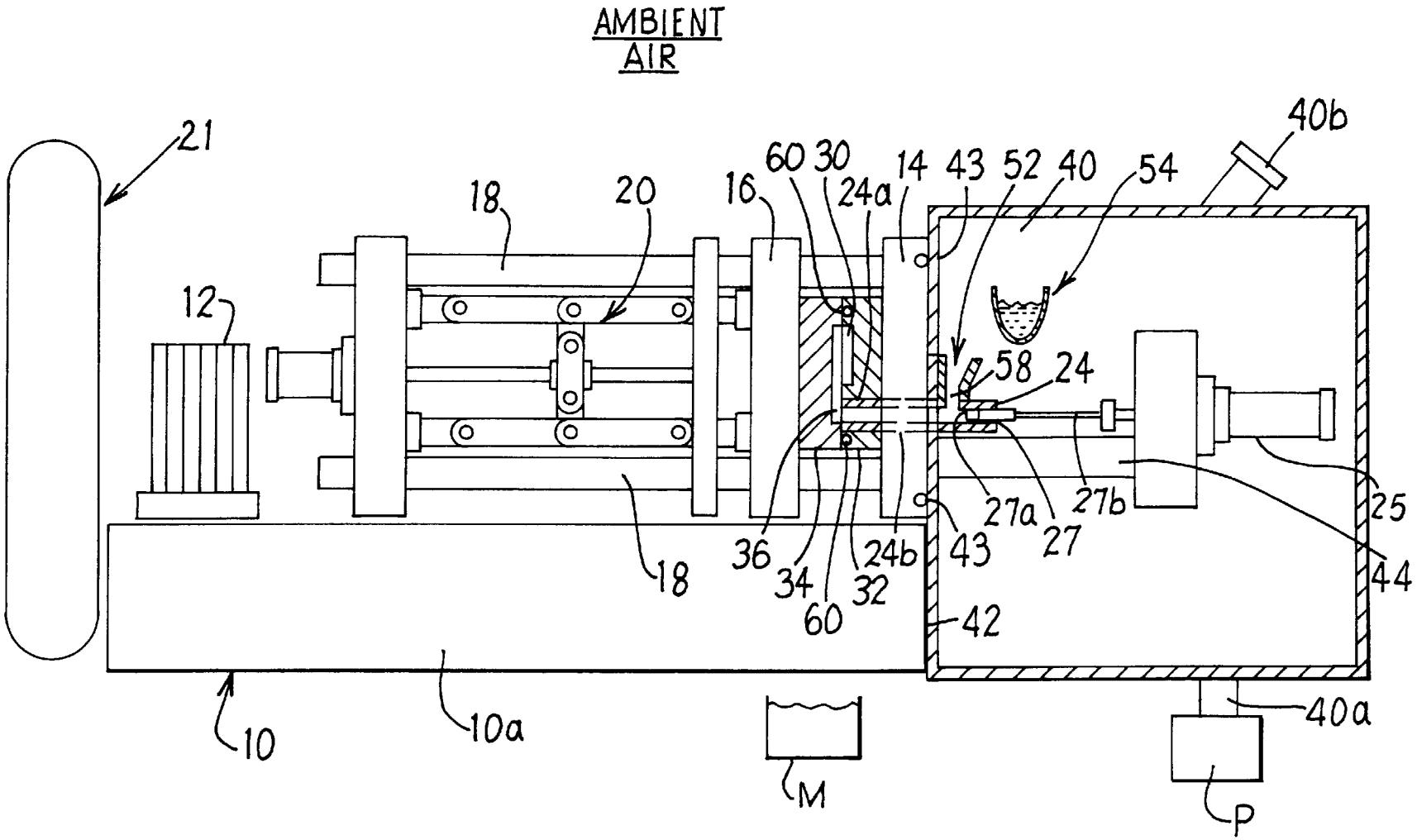
FIG. 1 is a side elevation of die casting apparatus for practicing a die casting method embodiment of the present invention with the shot sleeve vacuum chamber shown broken away.
Figure 2:
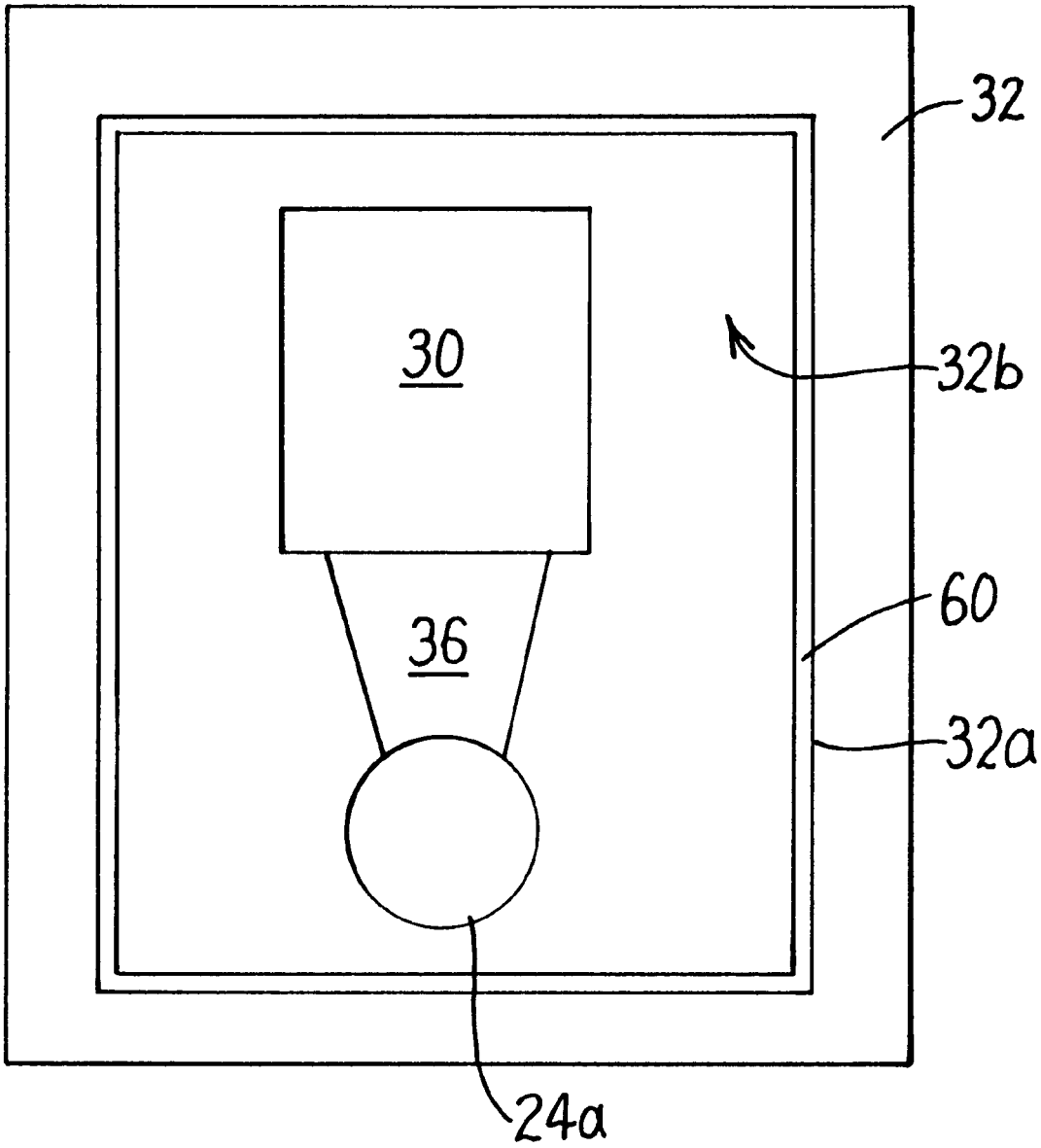
FIG. 2 is an enlarged elevational view of the stationary die showing a vacuum O-ring seal disposed in a groove in the die to seal against the other die when the dies are closed to isolate the die cavity from ambient air atmosphere.

The method of die casting amorphous metals and alloys pursuant to one embodiment of the invention is practiced using a high vacuum die casting machine of the type shown in FIGS. 1–2 and described in copending application Ser. No. 08/928,842.

Referring to FIGS. 1–2, the die casting apparatus is shown for die casting an amorphous metal or alloy under relatively high vacuum conditions in the die cavity despite the dies being disposed exteriorly in ambient air atmopshere. The die casting apparatus comprises a base 10 which defines therein a reservoir 10*a* for hydraulic fluid that is used by hydraulic actuator 12 to open and close the fixed and movable die platens 14, 16. The platen 16 is disposed for movement on stationary tie bars or rods 18. A die clamping linkage mechanism 20 is connected to the movable die platen 16 in conventional manner not considered part of the present invention to open/close the movable die 34 relative to fixed die 32 disposed on platen 14. For example, a conventional die casting machine available as 250 ton HPM #73-086 from HPM, Cleveland, Ohio, includes such a base 10, actuator 12, and die platens 14, 16 mounted on tie bars 18 and opened/closed by die clamping linkage mechanism 20 in the manner described. The die casting machine includes a gas accumulator 21 for rapid feeding of hydraulic fluid to the plunger mechanism.

The die casting apparatus comprises a tubular, horizontal shot sleeve 24 that communicates to a die cavity 30 defined by the dies 32, 34 disposed on the respective die platens 14, 16. One or more die cavities 30 can be formed by the dies 32, 34 to die cast one or more components. The shot sleeve 24 has a discharge end section 24*a* that communicates with an entrance passage or gate 36 to the one or more die cavities 30 so that molten metal or alloy can be pressure injected therein. The entrance passage or gate 36 can be machined in the stationay die 32 or the movable die 34, or both.

The discharge end section 24*a* of the shot sleeve 24 extends through a suitable passage 24*b* in the stationary platen 14 and die 32 as illustrated in FIG. 1.

The shot sleeve 24 extends through die 32 into a vacuum melting chamber 40 where the amorphous metal or alloy to be die cast is melted under relatively high vacuum conditions, such as less than 1000 microns. The vacuum chamber 40 is defined by a vacuum housing wall 42 that extends about and encompasses or surrounds the opposite charging end section of the shot sleeve 24 receiving the plunger 27 and the plunger hydraulic actuator 25. The vacuum chamber 40 is evacuated by a conventional vacuum pump P connected to the chamber 40 by a conduit 40*a*. The base 10 and the vacuum housing wall 42 rest on a concrete floor or other suitable support.

The chamber wall 42 is airtight sealed with the fixed platen 14 by a peripheral airtight seal(s) 43 located therebetween so as to sealingly enclose the shot sleeve 24 and a pair of side-by-side stationary, horizontal shot sleeve/plunger support members 44 (one shown) extending through chamber wall 42. Such shot sleeve/plunger support members are provided on the aforementioned conventional die casting machine (250 ton HPM #73-086).

A plunger 27 is disposed in the shot sleeve 24 for movement by plunger actuator 27 and plunger connector rod 27*b* between a start injection position located to the right of a melt entry or inlet opening 58 in shot sleeve 24 and a finish injection position proximate the die entrance or gate 36. The melt inlet opening 58 communicates to a metal (e.g. steel) melt-receiving vessel 52 mounted adjacent the fixed platen 14 on the shot sleeve 24 by clamps, such as screw clamps (not shown). The melt-receiving vessel 52 is disposed beneath a melting crucible 54 to receive a charge of molten metal or alloy therefrom for die casting.

The melting crucible 54 may be an induction skull crucible comprising copper segments in which a charge of solid metal or alloy to be die cast is charged via vacuum port 40*a* and melted by energization of induction coils 56 disposed about the crucible in conventional manner in the chamber 40. Known ceramic or refractory lined crucibles also can be used in practicing the present invention. The crucible 54 can be tilted by rotation about crucible trunnions T using a conventional hydraulic, electrical or other actuator (not shown) disposed outside the vacuum chamber 40 and connected to the crucible by a suitable vacuum sealed linkage extending from the actuator to the crucible. The crucible is tilted to pour the molten metal or alloy charge into the melt-receiving vessel 52, which is communicated to the shot sleeve 24 via opening 58 in the shot sleeve wall. The molten metal or alloy charge is introduced through opening 58 into the shot sleeve 24 in front of the plunger tip 27*a*.

In practicing an embodiment of the present invention, the molten amoprhous metal or alloy charge is introduced into the shot sleeve in an amount that is less than 40 volume % of the effective internal volume of the shot sleeve defined in front of plunger tip 27*a* and extending to the entrance or gate 36 of the die cavity. Preferably, the amount of molten metal or alloy occupies less than 20 volume %, and even more preferably from about 8 to about 15 volume % of the effective internal volume of the shot sleeve. Such a relatively low volume of molten charge relative to shot sleeve internal volume provides a relatively low molten charge profile in the shot sleeve (i.e. the molten charge lies more along the bottom of the shot sleeve) to thereby reduce the contact area and contact time of the molten charge with the plunger tip 27*a* and resultant swelling of the the plunger tip prior to melt injection into the mold cavity.

In die casting of amorphous zirconium-copper-nickel-berylium alloys as an ilustrative example, the shot sleeve 24 and forward plunger tip 27*a* contacting the molten metal or alloy can be made of an iron or copper based material, such as H-13 tool steel, or a refractory material such as based on Mo alloy or TZM alloy, ceramic material such as alumina, or combinations thereof that are compatible with the metal or alloy being melted and die cast. The plunger tip 27*a* can comprise a disposable tip that is thrown away after each molten metal or alloy charge is injected in the die cavity 30. A disposable plunger tip can comprise a copper based alloy such as a copper-beryllium alloy (e.g. #20 alloy) having an outer circumferential H-13 steel expandible piston ring type seal (for example only ½ inch ring width and ⅛ inch ring thickness) received in a complementary circumferential groove in the plunger tip for providing an improved seal with zero or near zero clearance with the inner wall of the shot sleeve 24.

In die casting amorphous zirconium-copper-nickel-berylium alloys, the dies 32, 34 can be made of steel and/or titanium pursuant to Colvin U.S. Pat. No. 5,287,910, although other die materials such as molybdenum, tungsten, etc. may be used in practicing the invention.

Referring to FIG. 1, the first and second dies 32, 34 are disposed outside the vacuum melting chamber 40 in ambient air atmosphere. That is, exterior surfaces or sides of the dies 32, 34 are exposed to ambient air atmosphere.

When the dies 32, 34 are closed, the die cavity 30 defined therebetween is communicated to the vacuum chamber 40 via the shot sleeve 24 and can be evacuated through the shot sleeve.

The stationary die 32 typically includes a series of grooves 32*a* on its inner face 32*b* (one groove shown in FIG. 2) that mates with the opposing inner face of the movable die 34 when the dies are closed. The groove(s) 32*a* encircle or extend about the die cavity 30 as well as gate 36 and metal discharge opening communicated to gate 36 and defined by shot sleeve end 24*a*. The groove 32*a* receives a resilent, reusable high temperature O-ring vacuum seal 60 for sealing in vacuum tight manner against the mating face 34*b* of the movable die 34 when the dies are closed. Alternately, the seal(s) 60 can be disposed in grooves on the mating face of the movable die 34, or they can be disposed on the mating faces of both dies 32, 34, so as to form a vacuum tight seal about and isolating the die cavity 30, gate 36, and shot sleeve end 24*a* from the ambient air atmosphere surrounding the exterior of the dies 32, 34 when closed. A series of several grooves and O-ring seals can be provided progressively outwardly relative to the die cavity perimeter to form a plurality of vacuum tight seals. The vacuum seals 60 may comprises Viton material that can withstand temperatures as high as 400 degrees F. that may be present when the die cavity 30 is filled with molten metal or alloy.

By use of vacuum seals 60, the die cavity 30 is isolated from the ambient air atmosphere when the dies 32, 34 are closed and enables the die cavity 30 to be evacuated through the shot sleeve 24 when the vacuum melting chamber 40 is evacuated to high vacuum levels of less than 1000 microns, preferably about 25 microns or less, employed for melting the solid charge in the crucible 54.

In operation of the die casting apparatus of FIG. 1, a solid metal or alloy comprising, for example only, an amorphous zirconium-copper-nickel-berylium alloy, such as Vitreloy amorphous alloy having a nominal composition of 63% Zr-11% Ti-12.5% Cu-10% Ni-3.5% Be, in weight %, and described in detail in U.S. Pat. No. 5,288,344, the teachings of which are incorporated herein by reference, is charged into the crucible 54 in the vaccuum melting chamber 40 via port 40*a*. The vacuum chamber 40 then is evacuated to a suitable level (e.g. less than 1000 microns, preferably about 25 microns or less) for melting the Vitreloy alloy by vacuum pump P. The die cavity 30 formed by the closed dies 32, 34 initally is concurrently evacuated to the same vacuum level through the connection to the vacuum melting chamber 40 via the shot sleeve 24 and by virtue of being isolated from surrounding ambient atmosphere by the vacuum seal(s) 60. The dies 32, 34 initally can be at ambient temperature. A parting agent can be applied to the surfaces of the dies 32, 34 that mate when the dies are closed. Parting agents can be selected from graphite spray, an aqueous graphite dispersion, zirconia spray, yttria spray, and other conventional parting agents typically applied by spraying or coating to the die surfaces.

The molten charge (e.g. 5 to 15 pounds of the amorphous alloy in crucible 54 is superheated to 300 degrees F. above the alloy melting temperature (1325 degrees F.) and is poured under vacuum into the shot sleeve 24 via the vessl 52 and melt inlet opening 58 with the plunger 27 initially positioned at the start injection position of FIG. 1. An exemplary shot sleeve has a length of 16.5 inches and diameter of 3 inches and can include therein a copper-berylium plunger tip having a typical radial clearance of 0.002 inch with the shot sleeve, more generally a radial clearance in the range of 0.001 inch to 0.010 inch with the shot sleeve. The aforementioned piston ring type circumferential seal preferably is provided on the circumfernece of the plunger tip to provide zero or near zero clearance with the inner wall of the shot sleeve.

The molten amorphous alloy is introduced into the shot sleeve 24 in an amount that is less than than 40 volume % of the effective internal volume of the shot sleeve. Preferably, the amount of molten charge occupies less than 40 volume % of the effective internal volume of the shot sleeve, and even more preferably from about 8 to about 15 volume % of the shot sleeve internal volume. An exemplary Vitreloy molten charge occupies approximately 20 volume % of the effective shot sleeve volume.

The molten metal or alloy is poured into the shot sleeve 24 and resides therein for a preselected dwell time of between 0.005 seconds and 4 seconds, typically 0.1 second to 1.5 seconds, for the purpose of insuring that no molten alloy gets behind the plunger 27. The melt of amorphous alloy alternately can be poured directly from the crucible 54 via vessel 52 into the shot sleeve 24, thereby reducing time and metal cooling before injection can begin.

The plunger 27 then is advanced in the shot sleeve 24 by actuator 25 at plunger speeds in the range of 5 inches/second to 500 inches/second to pressure inject the molten metal or alloy into the die cavity 30 via entrance passage or gate 36. The molten amorphous alloy is forced at high velocities, such as up to 150 inches per second, down the shot sleeve 24 and into the sealed, evacuated die cavity 30. An exemplary plunger speed useful for die casting the Vitreloy molten alloy charge is 75 inches/second.

After the molten amorphous alloy has been injected into the die cavity, the dies 32, 34 are opened by movement of die 34 relative to die 32 within a typical time period that can range from 5 to 25 seconds following injection to provide enough time for the molten alloy to form at least a solidified surface on the die cast component(s). The dies 32, 34 then are opened to allow ready removal of the die cast component (s) from the dies. A conventional ejector pin mechanism (not shown) provided on the aformentioned HPM die casting machine helps eject the components(s) from the dies. Removal of the die cast component(s) can be made directly from the dies 32, 34 simply by opening the dies without further cooling of the cast component(s). This is advantageous to increase production output of die cast components. When the dies are opened, the vacuum seal(s) 60 is/are broken, and the die cast component(s) is/are exposed to ambient air atmosphere, removed from the die cavity and quenched immediately (e.g. within 15 seconds) in the quenching medium M, such as preferably water or oil, located proximate the open dies 32, 34 at a cooling rate sufficient to provide a die cast microstructure having at least 50 volume % or more, preferably approaching 100%, amorphous phase. Generally, an exemplary Vitreloy die cast component is cooled to below 600 degrees F. in less than 2 minutes to provide a die cast microstructure having at least 50 volume % or more, such as approaching 100%, of amorphous phase.

The invention has been used to die cast complex three dimensional net shape components, such as golf club putters, from the amorphous Vitreloy alloy under the above decribed conditions.

In practicing the embodiments of the invention described above, the temperature of the dies 32, 34 optionally can be controlled within desired ranges to provide die temperatures in the range of 100–700 degrees F. For example, the dies 32, 34 can be preheated prior to the start of injection of the molten metal or alloy therein by one or more conventional gas flame burners or electrical resistance heating wires operably associated with the dies to this end. The dies 32, 34 can be cooled by water cooling conduits (not shown) formed internally of the dies and through which coolng water is circulated to control die temperature as die cast components continue to be made and the dies heat up. The shot sleeve similarly also optionally can be heated or cooled to control shot sleeve temperature within a desired range such as 100–700 degrees F. by similar gas flame burners or electrical resistance wires or water cooling passages in the shot sleeve.

While the invention has been described in terms of specific embodiments thereof, it is not intended to be thereto but rather only to the extent set forth in the following claims.

I claim:

1. A method of die casting an amorphous metal or alloy, comprising:

heating the metal or alloy above a melting temperature thereof under vacuum in a vacuum chamber, evacuating a die cavity that receives the melted metal or alloy, introducing the melted metal or alloy into a shot sleeve ahead of a plunger and communicating to the die cavity, advancing the plunger in the shot sleeve toward the die cavity to inject the melted metal or alloy into the evacuated die cavity, opening the dies, removing from said die cavity a die cast component having an outer shell formed on said component in said die cavity, and quenching the die cast component in a quenching medium after removal from said die cavity to cool the die cast component to produce a quenched substantially amorphous microstructure.

2. A method of die casting an amorphous metal or alloy, comprising:

heating the metal or alloy above a melting temperature thereof in a vacuum chamber communicated to a die cavity by a shot sleeve, evacuating the vacuum chamber to less than 1000 microns and the die cavity through the shot sleeve while sealing the die cavity from ambient air atmosphere by one or more vacuum seals between said dies, introducing the melted metal or alloy into the shot sleeve ahead of a plunger, advancing the plunger toward the die cavity to inject the melted metal or alloy into the sealed, evacuated die cavity, opening the sealed dies, removing from said die cavity a die cast component having an outer shell formed on said component in said die cavity, and quenching the die cast component in a quenching medium after removal from said die cavity to produce a quenched substantially amorphous microstructure.

3. The method of claim 2 wherein the die cast component is quenched in a water bath proximate the dies.

4. The method of claim 2 wherein the shot sleeve is advanced at speeds in the range of 5 inches/second to 500 inches/second.

5. The method of claim 2 wherein a zirconium-copper-nickel-berylium alloy is melted.

6. The method of claim 2 including applying a parting agent selected from zirconia, yttria, and graphite to die cavity surfaces.

7. The method of claim 2 wherein the vacuum chamber is evacuated to about 25 microns or less.

* * * * *

UNITED STATES PATENT AND TRADEMARK OFFICE
Certificate

Patent No. 6,021,840

Patented: February 8, 2000

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Gregory N. Colvin, Muskegon, MI; and Atakan Peker, Aliso Viejo, CA; Mountain View, CA.

Signed and Sealed this Ninth Day of March 2004.

TOM G. DUNN
*Supervisory Patent Examiner*
Art Unit 1725

UNITED STATES PATENT AND TRADEMARK OFFICE
Certificate

Patent No. 6,021,840 Patented: February 8, 2000

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: patent is: Gregory N. Colvin, Muskegon, MI; Atakan Peker, Aliso Viejo, CA; and David S. Lee, Mountain View, CA.

Signed and Sealed this Tenth Day of May 2005.

TOM G. DUNN
*Supervisory Patent Examiner*
Art Unit 1725